United States Patent [19]

Withington

[11] 4,446,798

[45] May 8, 1984

[54] SAFE BOLT MECHANISM

[76] Inventor: Clinton E. Withington, 391 Stewart Dr., Hayward, Calif. 94544

[21] Appl. No.: 362,260

[22] Filed: Mar. 26, 1982

[51] Int. Cl.[3] ..... E05G 1/04

[52] U.S. Cl. ..... 109/61; 292/37; 109/59 R

[58] Field of Search ..... 109/58, 58.5, 58 R, 109/59 R, 60, 61, 64, 70, 71, 73, 74; 292/34, 37, 170

[56] References Cited

U.S. PATENT DOCUMENTS

| | | | |
|---|---|---|---|
| 609,416 | 8/1898 | Damon | 292/37 |
| 928,905 | 7/1909 | Cottrell | 292/37 |
| 2,119,996 | 6/1938 | Massholder | 292/37 |
| 3,418,951 | 12/1968 | Belew | 109/59 |
| 3,426,707 | 2/1969 | Heyl et al. | 109/59 |
| 3,893,723 | 7/1975 | Boule | 292/170 |
| 4,168,616 | 9/1979 | Goldman | 292/34 |

*Primary Examiner*—Robert P. Suiatek

*Assistant Examiner*—Kris R. Schulze

*Attorney, Agent, or Firm*—Linval B. Castle

[57] ABSTRACT

An improved safe bolt mechanism characterized by: slide bolts coupled to an inner surface of the safe's door by an elongated channel member; guide bars intespaced with the slide bolts and guided by the channel member for movement perpendicular to the slide bolts; elongated, bent cam rods journaled within apertures provided in the slide bolts and connected at their ends to successive guide bars; and a lockable bolt actuating mechanism for moving the guide bars within the channel member and thus extending or retracting the slide bolts due to the interaction of the cam rods and the slide bolts. Each of the slide bolts is individually locked by the cam rods to make forced entry into the safe more difficult. Optional locking pins attached to the guide bars can engage transverse bores provided in the slide bolts to lock the individual slide bolts even more securely.

8 Claims, 6 Drawing Figures

10
12
14
16
18
20
22
24
26
28
30
32
38b
40
42
44
46
52
54
58
60
68
70
2
3
A
0
10
20
30
40
50
60
70
80
90

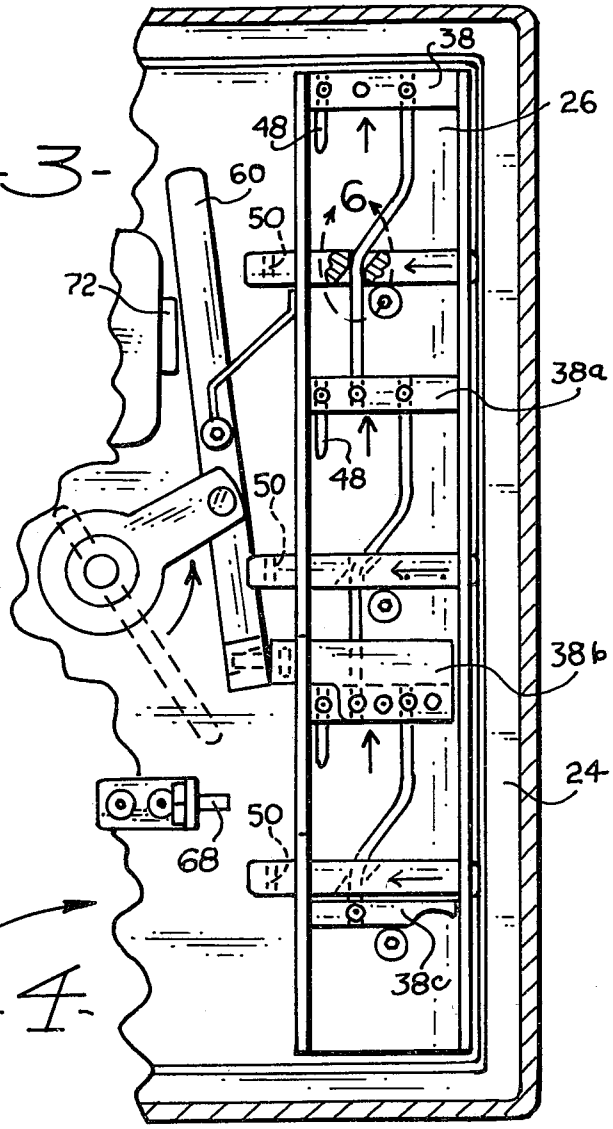
FIG. 3
FIG. 4
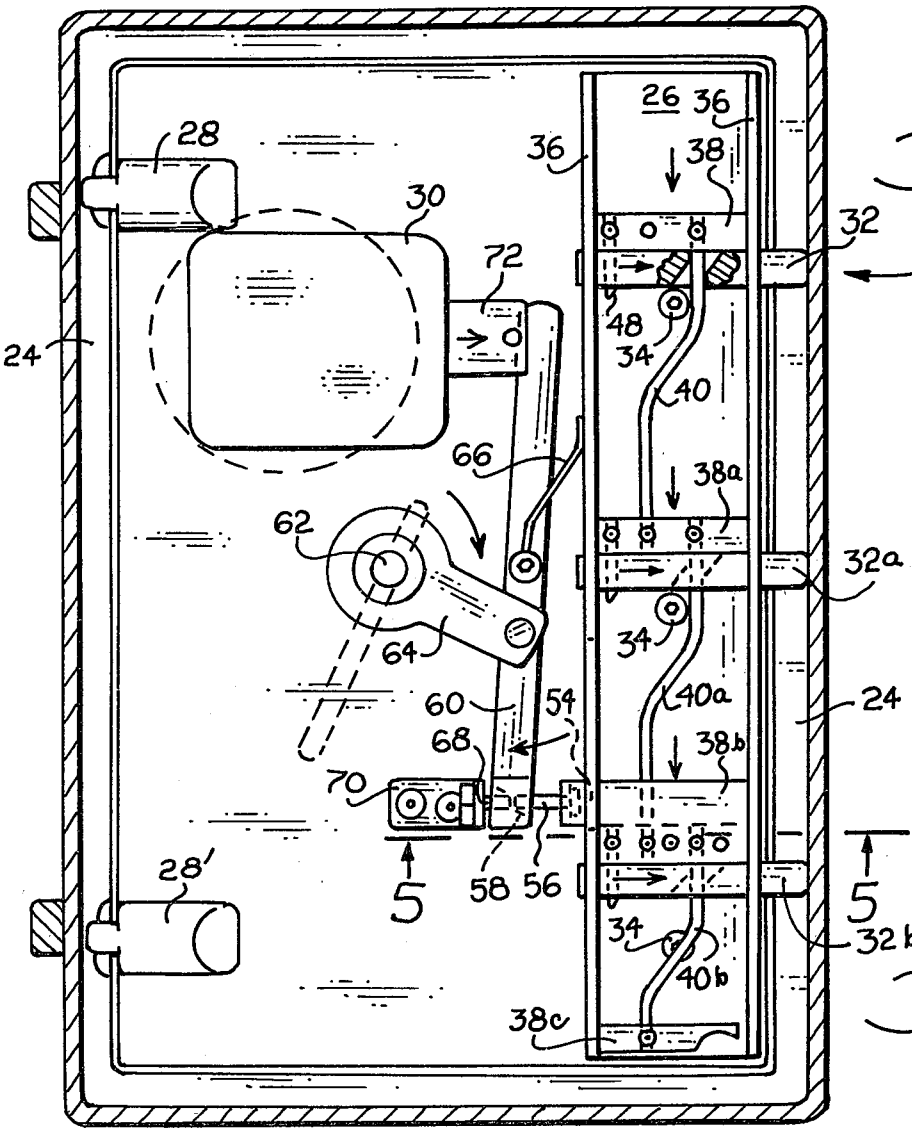

SAFE BOLT MECHANISM

BACKGROUND OF THE INVENTION

1. Field of the Invention

This invention relates generally to security devices and more particularly to safes and safe mechanisms.

2. Description of the Prior Art

Safes generally include a fortified box having a single opening or access, and a strong, lockable door associated with the opening. The doors on larger safes are usually hinged to the safe box.

A safe bolt mechanism is typically either built into the safe door or is attached to the inner surface of the safe door. The mechanism includes one or more slide bolts, a slide bolt actuating assembly, and a lock for disabling the actuating assembly. The locks are usually combination type locks because they have no keyholes into which explosives or lock-picking tools can be inserted.

Most quality safes are provided with multiple slide bolts operated simultaneously by the actuating assembly. Examples of multiple bolt safe mechanisms can be found in U.S. Pat. Nos. 609,416 of G. L. Damon, and 4,168,616 of Goldman.

Multiple slide bolt mechanisms of the prior art can be defeated by the experienced safe-cracker. Since all of the slide bolts are coupled together, the canny thief can drill through the side of the safe box and drive out a single bolt to open the safe. This presents very real security problems to any multiple slide bolt safe having an exposed safe box.

SUMMARY OF THE INVENTION

An object of this invention is to provide a multiple slide bolt safe mechanism which is highly resistant to tampering.

Another object of this invention is to provide a safe construction particularly suited for the safe bolt mechanism described herein.

Briefly, the safe of the present invention includes a safe box, a safe door hinged to the safe box, a channel shaped guide track attached to the inner surface of the safe door, a number of slide bolts engaged with transverse bores provided through the sidewalls of the track, a plurality of locking bars interspaced with the slide bolts and guided by the sidewalls of the guide track, and a number of elongated, angled cam rods attaching successive locking bars together and engaging transverse apertures provided in the slide bolts. The locking bars are moved along the guide track by means of a linkage assembly coupled to the bolt actuating handle of the safe. As the locking bars are moved, the cam rods cause the slide bolts to move between their bolted and unbolted positions.

When extended, each of the slide bolts is individually locked in place by an associated cam rod and locking bar. For even greater security, each of the locking bars can be provided with a locking pin which engages a bore provided in the slide bolts when the slide bolts are in their extended or bolted position.

The linkage coupling the the bolt actuating handle to the locking bars includes an elongated swivel link, a cantilever link coupling the shaft of the actuating handle to a mid-length portion of the swivel link, and a slide link coupling a lower end of the swivel link to one of the locking bars. The tongue of a combination lock mechanism abuts a second end portion of the swivel link to engage or disengage that link from a locking pin affixed to the inner surface of the safe door.

A major advantage of this invention is that each of the slide bolts is individually locked into place so that the safe cannot be operated by driving out a single slide bolt.

These and other objects and advantages of the present invention will no doubt become apparent upon a reading of the following descriptions and a study of the several figures of the drawing.

BRIEF DESCRIPTION OF THE DRAWING

FIG. 3 is a cross-sectional view taken along line 3—3 of FIG. 2 showing the slide bolts in their extended or bolted positions.

FIG. 4 is a partial view of the cross-section of FIG. 3 with the slide bolts in their retracted or unbolted positions.

DETAILED DESCRIPTION OF THE PREFERRED EMBODIMENT(S)

Figures 1, 2, 5, 6:
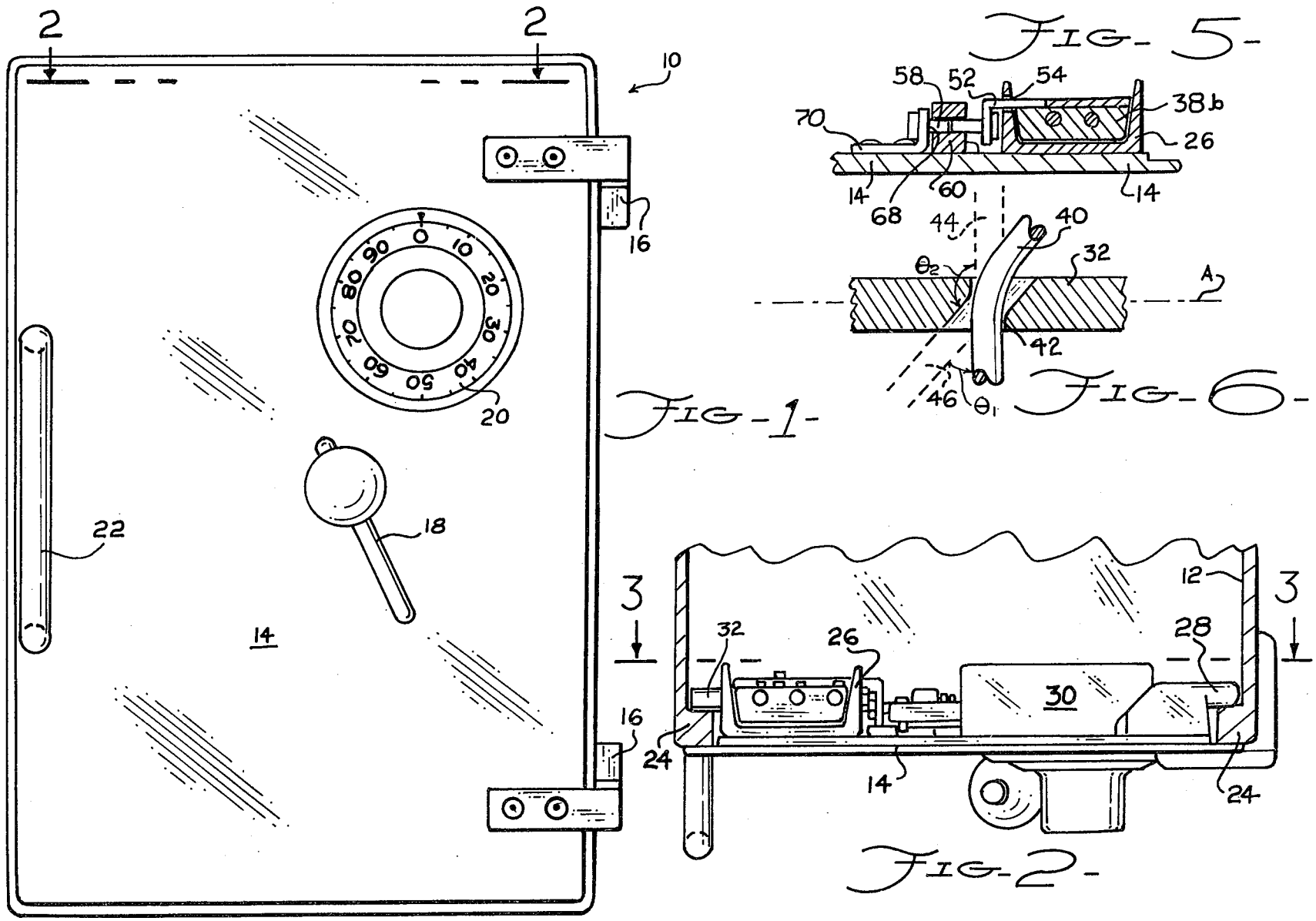
FIG. 1 is a front elevational view of a safe in accordance with the present invention.
FIG. 2 is a cross-sectional view taken along line 2—2 of FIG. 1.
FIG. 5 is a cross-sectional view taken along line 5—5 of FIG. 3.
FIG. 6 is an enlarged view of the portion of FIG. 4 encircled by line 6.

Referring to FIG. 1, a safe 10 in accordance with the present invention includes a box or main body 12, a safe door 14 attached to the main body by hinges 16, a bolt actuating handle 18, a combination lock 20, and a pull handle 22. The main body, safe door, and external fixtures of the safe are preferably hardened and reinforced in ways well known to those skilled in the art.

Shown in the cross-sectional view of FIG. 2, the main body 12 has a lip portion 24 at least partially surrounding the mouth of the safe. Attached to the inner surface of safe door 14 are a channel shaped guide member 26, fixed bolts including a fixed bolt 28, and the body 30 of the combination lock. A number of slide bolts including a slide bolt 32 are engaged with transverse bores provided in the sidewalls of the guide member 26.

In FIG. 3 the guide member 26 can be seen to be an elongated member having a base portion attached to the inner surface of the safe door by a plurality of fasteners, and having a pair of parallel sidewall portions 36 extending outwardly from the base portion. The sidewall portions not only support the slide bolts 32, **32*a*, and 32*b* for reciprocal lateral movement respective the guide member, but also serve as longitudinal guides for a number of locking bars 38, 38*a*, 38*b*, and 38*c***.

The locking bars **38–38*c* are coupled together by a number of bent cam rods 40, 40*a*, and 40*b***. The cam rods are elongated members having a pair of substantially parallel end portions obtusely depending from an angled central portion. The end portions of the cam rods engage transverse bores provided in the locking bars and are retained therein by fasteners such as set screws, rivets, etc.

With additional reference to FIG. 6, each of the slide bolts 32 is provided with a transverse cam aperture 42 through which one of the cam rods extends. In the illustrated embodiment the cam apertures each include a first bore surface 44 extending through the slide bolt substantially perpendicularly to the axis 'A' of the slide bolt, and a second bore surface 46 crossing the first bore surface 44 at an acute angle $\theta_1$ relative axis 'A' of the slide bolt. The angle $\theta_1$, which is preferably around 45°, coincides with the complement of the obtuse angle $\theta_2$ that the central portions of the cam rods make with the end portions of the cam rods.

The interaction of the locking bars 38, cam rods 40, and slide bolts 32 will become apparent by studying the positions of those members in FIGS. 3 and 4. Taking FIG. 3 as a starting position, it can be seen in FIG. 4 that as the locking bars 38 move upwardly within guide member 26, the interaction of the angled, central portions of the cam rods 40 with the cam apertures of the slide bolts 32 causes the slide bolts to retract to their unbolted positions. Conversely, as the locking bars 38 are moved down guide member 26, the cam rods cause the slide bolts to extend to their bolted positions in engagement with lip 24.

It will be noted that when the slide bolts 32 are fully extended they are individually locked into position by the straight end portions of the cam rods 40. In other words, a safe-cracker would have to drive out each of the three slide bolts to open the safe.

For extra strength, each of the locking bars 38 can be provided with an auxiliary locking pin 48 adapted to engage a transverse bore 50 provided through each of the slide bolts. As seen in FIG. 3, the individual locking pins 48 augment the locking effect of the cam rods 40 when the slide bolts 32 are in their extended or bolted positions.

With additional reference to FIG. 5, it may be seen that an angled end portion 52 of locking bar **38*b* extends through a slot 54 provided in the inner sidewall 36 of guide member 26. Attached to portion 52 is a slide pin 56 which loosely engages a bore 58 provided near the lower end of an elongated swivel link 60. The swivel link is coupled to the rotary shaft 62 of bolt actuating handle 18 by its pivotal attachment to a cantilever link 64 attached to the end of the shaft. A leaf spring 66 attached to the swivel link and bearing against a sidewall 36 of the guide member 26 biases the lower end of the swivel link towards the guide member. Also seen in FIG. 5 is a fixed locking pin 68 attached to the inner surface of the safe door by an angle bracket 70**.

Extending from body 30 of the combination lock is a locking tongue 72 that is in sliding engagement with an upper end portion of swivel link 60. When the swivel link is positioned as shown in FIG. 3, the extension of the locking tongue causes locking pin 68 to engage bore 58 at the lower end of the swivel link, immobilizing the bolt actuating handle 18.

To lock the safe, the safe door is closed and bolt actuating handle 18 is rotated to cause the slide bolts to extend to their bolted positions in engagement with the lip 24 surrounding the mouth of the main body of the safe. As shown in FIG. 5 the fixed bolts 28 attached to the door 14 is formed to engage lip 24 on the inner wall of the safe to prevent the safe door from being removed by the removal of hinges 16. The dial of the rotary combination lock is then spun to cause tongue 72 to press against the upper end of the swivel link to swivel the lower end of the link into engagement with locking pin 68. In this position the bolt actuating handle is immobilized and each of the slide bolts is individually locked in position.

To unlock the safe, the correct combination is dialed on the combination lock to cause tongue 72 to retract as shown in FIG. 4. The bolt actuating handle is then able to rotate to free the end of the swivel link from the locking pin 68. As the actuating handle continues to rotate the swivel link 60 moves upwardly, causing the locking bars 38 and cam rods 40 also to move upwardly. As described above, the upward movement of the cam rods causes the slide bolts 32 to retract to their unbolted positions.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. An improved safe bolt mechanism for a safe including a main body and a safe door hinged to said main body, said safe bolt mechanism comprising:

a plurality of slide bolts coupled to an inner surface of said door for reciprocal axial movement between a bolted and an unbolted position, each slide bolt being provided with a transverse cam aperture and a transverse locking pin bore substantially parallel thereto;

guide means attached to said inner surface in proximity to said slide bolts;

a plurality of guide bars interspaced with said slide bolts and guided by said guide means for reciprocal motion substantially perpendicular to the axes of said slide bolts, said guide bars having extending locking pins coaxial with each of said locking pin bores said locking pin engages one of said locking pin bores when said slide bolts are in said bolted position;

a plurality of elongated cam rods coupling successive guide bars together, each of said cam rods being journaled within the cam aperture of one of said slide bolts; and lockable bolt actuating means for reciprocally moving said guide bars along said guide means to urge said slide bolts between said bolted and said unbolted positions.

2. An improved safe as recited in claim 1 wherein said guide means includes an elongated channel member attached to said inner door surface, and wherein said guide bars are guided within the channel of said channel member.

3. An improved safe as recited in claim 2 wherein each of said cam rods includes a central portion that is acutely angled relative the axis of the slide bolt within which it is journaled.

4. An improved safe as recited in claim 3 wherein each of said cam apertures includes a first bore surface extending through said slide bolt substantially perpendicularly to said slide bolt axis, and a second bore surface crossing said first bore surface and extending through said slide bolt at an acute angle relative said slide bolt axis.

5. An improved safe as recited in claim 4 wherein each of said cam rods is substantially Z shaped with a pair of parallel end portions obtusely depending from said central portion.

6. An improved safe as recited in claim 2 wherein said bolt actuating means includes a bolt actuating handle assembly and a linkage assembly coupling said handle assembly to said guide bars, said linkage assembly including an elongated swivel link, a cantilever link attached at one end to said handle assembly and pivotally coupled at its other end to a mid-length portion of said swivel link, and a slide link coupling a first end of said swivel link to one of said guide bars.

7. An improved safe as recited in claim 6 further comprising a swivel link locking pin attached to said inner surface of said door and adapted to selectively engage a bore provided in said swivel link.

8. An improved safe as recited in claim 7 further comprising means biasing said first end of said swivel link away from said swivel link locking pin.

* * * * *